US005254153A

United States Patent [19]

Mudder

[11] Patent Number: 5,254,153

[45] Date of Patent: Oct. 19, 1993

[54] CYANIDE RECYCLING PROCESS

[75] Inventor: Terry I. Mudder, Duvall, Wash.

[73] Assignee: Cyprus Minerals Company, Englewood, Colo.

[21] Appl. No.: 817,288

[22] Filed: Jan. 6, 1992

Related U.S. Application Data

[63] Continuation-in-part of Ser. No. 424,765, Oct. 20, 1989, Pat. No. 5,078,977, which is a continuation-in-part of Ser. No. 261,386, Oct. 21, 1988, Pat. No. 4,994,243.

[51] Int. Cl.[5] ..... C22B 11/08; C01C 3/08

[52] U.S. Cl. ..... 75/732; 75/735; 75/737; 75/741; 423/29; 423/30; 423/31; 423/379

[58] Field of Search ..... 423/29, 30, 31, 379; 75/737, 732, 735, 741

[56] References Cited

U.S. PATENT DOCUMENTS

| | | | |
|---|---|---|---|
| 494,054 | 3/1893 | Birkin . | |
| 496,950 | 5/1893 | Parkes et al. . | |
| 705,698 | 7/1902 | Officer et al. . | |
| 820,810 | 5/1906 | Muffly . | |
| 823,576 | 6/1906 | Arnold . | |
| 1,387,289 | 8/1921 | Mills et al. . | |
| 3,403,020 | 9/1968 | Lower | 75/106 |
| 3,592,586 | 7/1971 | Scott | 23/79 |
| 3,617,567 | 11/1971 | Mathre | 210/50 |
| 4,250,030 | 2/1981 | Kuit et al. | 210/684 |
| 4,267,159 | 5/1981 | Crits | 423/371 |
| 4,289,532 | 9/1981 | Matson et al. | 75/105 |
| 4,312,760 | 1/1982 | Neville | 210/724 |
| 4,537,686 | 8/1985 | Borbely et al. | 210/713 |
| 4,578,163 | 3/1986 | Kunter et al. | 204/110 |
| 4,587,110 | 6/1986 | Potter et al. | 423/30 |
| 4,624,837 | 11/1986 | Baker | 423/236 |
| 4,654,079 | 3/1987 | Nunez et al. | 75/118 |
| 4,708,804 | 11/1987 | Coltrinari | 210/677 |
| 4,734,270 | 3/1988 | Touro et al. | 423/29 |
| 4,752,400 | 6/1988 | Pearson | 210/718 |
| 4,994,243 | 2/1991 | Goldstone et al. | 423/29 |

FOREIGN PATENT DOCUMENTS

| | | |
|---|---|---|
| 698706 | 11/1964 | Canada . |
| 8808408 | 11/1988 | PCT Int'l Appl. . |
| 8901357 | 2/1989 | PCT Int'l Appl. . |

OTHER PUBLICATIONS

"Cyanide and the Environment" (A Collection of Papers from the Proceedings of a Conference held in Tucson, Ariz., Dec. 11-14, 1984) edited by Dirk Van Zyl.

"Cyanidation and Concentration of Gold and Silver Ores," by Dorr and Bosqui, 2nd edition, published by McGraw-Hill Book Company, 1950.

"Canmet AVR Process for Cyanide Recovery and Environmental Pollution Control Applied to Gold Cyanidation Barren Bleed from Campbell Red Lakes Mines, Limited, Balmerton, Ontario," by Vern M. McNamara, Mar., 1985.

"Removal of Cyanide from Gold Mill Effluents," by Ingles and Scott, presented at the Canadian Mineral Processors 13th Annual Meeting, Ottawa, Ontario, Canada, Jan. 20-22, 1981.

"Overview of Cyanide Treatment Methods," by Ingles and Scott, presented at the Canadian Mineral Processors 13th Annual Meeting, Ottawa, Ontario, Canada, Jan. 20-22, 1981.

(List continued on next page.)

*Primary Examiner*—Wayne Langel

*Attorney, Agent, or Firm*—Sheridan, Ross & McIntosh

[57] ABSTRACT

A process for recycling hydrogen cyanide from a cyanide-containing slurry is provided. The process includes the steps of adjusting the pH of a cyanide-containing slurry, volatilizing HCN contained in the pH adjusted slurry and contacting the volatilized HCN with a precious metals-containing slurry to recover precious metals therefrom. Alternatively, the HCN can be contacted with reclaim, or decant, water to recover cyanide, thereby conserving resources.

28 Claims, 2 Drawing Sheets

OTHER PUBLICATIONS

"Golconda Claims World First for Cyanide Regeneration Process," by Doug Wilson, Gold Gazette, Dec. 7, 1987, p. 35.

"New Process Regenerates Cyanide from Gold and Silver Leach Liquors," The Engineering and Mining Journal, Jun., 1988, p. 55.

"Cyanide Regeneration," Mining, Jul., 1988, pp. 60-61.

"Cyanide Regeneration from Gold Tailings—Golconda's Beaconsfield Experience," by Michael J. Kitney, Perth Gold 88, pp. 89-93.

"New Hydrometallurgical Process for Au Recovery from Cyanide Solution," Mining Magazine, Jan., 1988, pp. 60-61.

"The Application of Cyanide Regeneration to the Treatment of Refractory, Complex or Copper Bearing Ores as Practiced by Companie de Real del Montey Pauchauca," by Frank A. Seeton.

"Stripping of HCN in a Packed Tower," by Avedesian, Spira and Canduth, The Canadian Journal of Chemical Engineering, vol. 61, Dec., 1983, pp. 801-806.

"Vapor-Liquid Equilibria in Multicomponent Aqueous Solutions of Volatile Weak Electrolytes," by Edwards, Maurer, Newman and Prasnitz, AIChE Journal, vol. 24, No. 6, Nov. 1978, pp. 966-976.

"Precious Metals," Section 18, by McQuiston, Jr. and Shoemaker.

"Principles of Industrial Waste Treatment," by Gurnham, Section Entitled Ion Exchange Applications, pp. 242-245.

CYANIDE RECYCLING PROCESS

This is a continuation-in-part application of U.S. Pat. application Ser. No. 07/424,765, filed Oct. 20, 1989, now U.S. Pat. No. 5,078,977 issued Jan. 7, 1992, which is a continuation-in-part application of U.S. Pat. application Ser. No. 07/261,386 filed Oct. 21, 1988, now U.S. Pat. No. 4,994,243, issued Feb. 19, 1991, both of which are incorporated herein by reference in their entirety.

FIELD OF THE INVENTION

The present invention relates to cyanide removal and recovery from cyanide-containing mixtures, and in particular, a process for recovering cyanide from a waste stream and directly recycling the cyanide as HCN to a metals recovery step.

BACKGROUND OF THE INVENTION

Cyanides are useful materials industrially and have been employed in fields such as electro-plating and electro-winning of metals, gold and silver recovery from ores, treatment of sulfide ore slurries in flotation, tannery processes, etc. Due to environmental concerns, it is desirable to remove or destroy the cyanide present in the waste solutions resulting from such processes. Additionally, in view of the cost of cyanide, it is desirable to regenerate the cyanide for reuse in an efficient manner.

Techniques for cyanide disposal or regeneration (recovery) in waste solutions include: ion exchange, oxidation by chemical or electrochemical means, and acidification-volatilization-reneutralization (AVR). The terms recovery and regeneration are used interchangeably herein.

U.S. Pat. No. 4,267,159 by Crits issued May 12, 1981, discloses a process for regenerating cyanide in spent aqueous liquor by passing the liquor through a bed of suitable ion exchange resin to segregate the cyanide.

U.S. Pat. No. 4,708,804 by Coltrinari issued Nov. 24, 1987, discloses a process for recovering cyanide from waste streams which includes passing the waste stream through a weak base anion exchange resin in order to concentrate the cyanide. The concentrated cyanide stream is then subjected to an acidification/volatilization process in order to recover the cyanide from the concentrated waste stream.

U.S. Pat. No. 4,312,760 by Neville issued Jan. 26, 1982, discloses a method for removing cyanides from waste water by the addition of ferrous bisulfite which forms insoluble Prussian blue and other reaction products.

U.S. Pat. No. 4,537,686 by Borbely et al. issued Aug. 27, 1985, discloses a process for removing cyanide from aqueous streams which includes the step of oxidizing the cyanide. The aqueous stream is treated with sulfur dioxide or an alkali or alkaline earth metal sulfite or bisulfite in the presence of excess oxygen and a metal catalyst, preferably copper. This process is preferably carried out at a pH in the range of pH 5 to pH 12.

U.S. Pat. No. 3,617,567 by Mathre issued Nov. 2, 1971, discloses a method for destroying cyanide anions in aqueous solutions using hydrogen peroxide ($H_2O_2$) and a soluble metal compound catalyst, such as soluble copper, to increase the reaction rate. The pH of the cyanide solution to be treated is adjusted with acid or base to between pH 8.3 and pH 11.

Treatments based on oxidation techniques have a number of disadvantages. A primary disadvantage is that no cyanide is regenerated for reuse. Additionally, reagent costs are high, and some reagents (e.g. $H_2O_2$) react with tailing solids. Also, in both the Borbely et al. and Mathre processes discussed above, a catalyst, such as copper, must be added.

U.S. Pat. No. 3,592,586 by Scott issued Jul. 13, 1971, describes an AVR process for converting cyanide wastes into sodium cyanide in which the wastes are heated and the pH is adjusted to between about pH 2 and about pH 4 in order to produce hydrogen cyanide (HCN). The HCN is then reacted with sodium hydroxide in order to form sodium cyanide. Although the process disclosed in the Scott patent is described with reference to waste produced in the electro-plating industry, AVR processes have also been applied to spent cyanide leachate resulting from the processing of ores. Such spent cyanide leachate typically has a pH greater than about pH 10.5 prior to its acidification to form HCN.

AVR processes employed in the mineral processing field are described in the two volume set "Cyanide and the Environment" (a collection of papers from the proceedings of a conference held in Tucson, Ariz., Dec. 11-14, 1984), edited by Dirk Van Zyl. Also, see "Cyanidation and Concentration of Gold and Silver Ores," by Dorr and Bosqui, Second Edition, published by McGraw-Hill Book Company 1950, and "Cyanide in the Gold Mining Industry: A Technical Seminar," sponsored by Environment Canada and Canadian Mineral Processor, Jan. 20-22, 1981. Another description of an AVR process can be found in "Canmet AVR Process for Cyanide Recovery and Environmental Pollution Control Applied to Gold Cyanidation Barren Bleed from Campbell Red Lakes Mines Limited, Balmerton, Ontario," by Vern M. McNamara, March 1985. In the Canmet process, the barren bleed was acidified with $H_2SO_4$ to a pH level typically between pH 2.4 and pH 2.5. $SO_2$ and $H_2SO_3$ were also suitable for use in the acidification.

AVR processes take advantage of the volatile nature of hydrogen cyanide at low pH. In an AVR process, the waste stream is first acidified to a low pH (e.g. pH 2 to pH 4) to dissociate cyanide from metal complexes and to convert it to HCN. The HCN is volatilized, usually by air sparging. The HCN evolved is then recovered in a lime solution, and the treated waste stream is then reneutralized. A commercialized AVR method known as the Mills-Crowe method is described in a paper by Scott and Ingles, "Removal of Cyanide from Gold Mill Effluents," Paper No. 21 of the Canadian Mineral Processors 13th Annual Meeting, in Ottawa, Ontario, Canada, Jan. 20-22, 1981.

A process using AVR to recover cyanide values from a liquid is described in Patent Cooperation Treaty application PCT/AU88/00119, International Publication No. WO88/08408, of Golconda Engineering and Mining Services PTY. LTD. The disclosed process involves treating a tailings liquor from a minerals extraction plant by adjusting the pH into the acid range to cause the formation of free hydrogen cyanide gas. The liquid is then passed through an array of aeration columns arranged in stages so that the liquid flowing from one aeration column in a first stage is divided into two or more streams which are introduced into separate aeration columns in successive stages. In a recent paper describing the process, it was stated that plant shutdown would occur if the pH went above pH 3.5. In a commonly assigned application, PCT/AU88/00303, International Publication No. WO89/081357, a process for clarifying liquors containing suspended solids is disclosed. The feed slurry is acidified to a pH of pH 3.0 or lower. Flocculants are added to cause the formation of flocs to enable the separation of the suspended solids from the liquor. The clarified liquor can then be used as a feedstock for the AVR process disclosed in the other commonly assigned application.

The AVR processes described in the Scott patent and the above-mentioned texts typically include the step of volatilizing HCN by contacting with air and then contacting the volatilized HCN with a basic material to convert HCN to a cyanide salt. The above-mentioned references also only disclose a treatment of barren bleed which typically results from Merrill-Crowe type cyanidation treatment of ore. This bleed does not contain solid tailings. Today many ores are treated by a carbon-in-leach or carbon-in-pulp cyanidation process. The tailings from such processes include the solid processed ore in the spent leachate. Typically the tailing slurries contain about 30% to 40% by weight solids and about 100 to 350 parts per million (ppm) cyanide. In the past, such tailings were typically impounded and the cyanide contained therein was allowed to degrade naturally. Due to environmental concerns about cyanide, such impoundment is not a desirable alternative in many situations. Therefore, it is often necessary to treat the material in some manner to decompose the cyanide. This is expensive due to the costs associated with the treatment, as well as the loss of cyanide values which results.

Therefore, it would be advantageous to extract and recycle cyanide from a cyanide-containing waste stream. Further, it would be advantageous to provide a process for treating cyanide-containing slurries which also contain ore tailings. It would be advantageous if the amount of cyanide present in the waste stream could be reduced. It would also be advantageous to regenerate the cyanide for reuse directly in the precious metals recovery circuit.

It has now been discovered that when the HCN is volatilized in the cyanide-containing waste stream, the HCN can be recycled to a cyanide recovery tower where it is contacted directly with a stream containing precious metals-containing ore, to recover precious metals therefrom. The use of such a process advantageously minimizes the input of bulk cyanide into the precious metals recovery system. The system can operate essentially as a closed system and does not require significant amounts of additional cyanide.

Further, the equipment and raw materials previously necessary for the reabsorption of cyanide into caustic solution is no longer required. This advantageously eliminates both equipment and raw material cost.

SUMMARY OF THE INVENTION

In accordance with the present invention, a process is provided for recycling cyanide in a precious metals recovery circuit. The process includes the steps of adjusting the pH of a cyanide-containing waste stream, volatilizing HCN in the waste stream, and contacting the volatilized HCN with the precious metals-containing ore slurry.

In one embodiment, the pH of the cyanide-containing stream is adjusted using an acid, preferably $H_2SO_4$. In another embodiment, the cyanide-containing waste stream is a tailings slurry, preferably resulting from a carbon-in-leach recovery process or a carbon-in-pulp recovery process.

In one embodiment, the pH of the waste stream is adjusted to from about pH 5.0 to about pH 8.5 and in a preferred embodiment, the pH is adjusted to from about pH 6 to about pH 8.5. In one embodiment, the volatilization is accomplished by introducing air into the pH adjusted solution or by introducing the pH adjusted solution into air. In yet another embodiment of the present invention, the precious metals are selected from the group consisting of silver and gold.

In another embodiment of the present invention, a process for recovering cyanide by using reclaim or decant water is provided. The process includes the steps of volatilizing HCN in a cyanide-containing waste stream, contacting the volatilized HCN with reclaim or decant water, and recovering cyanide from the reclaim or decant water.

DESCRIPTION OF PREFERRED EMBODIMENTS

Figure 1:
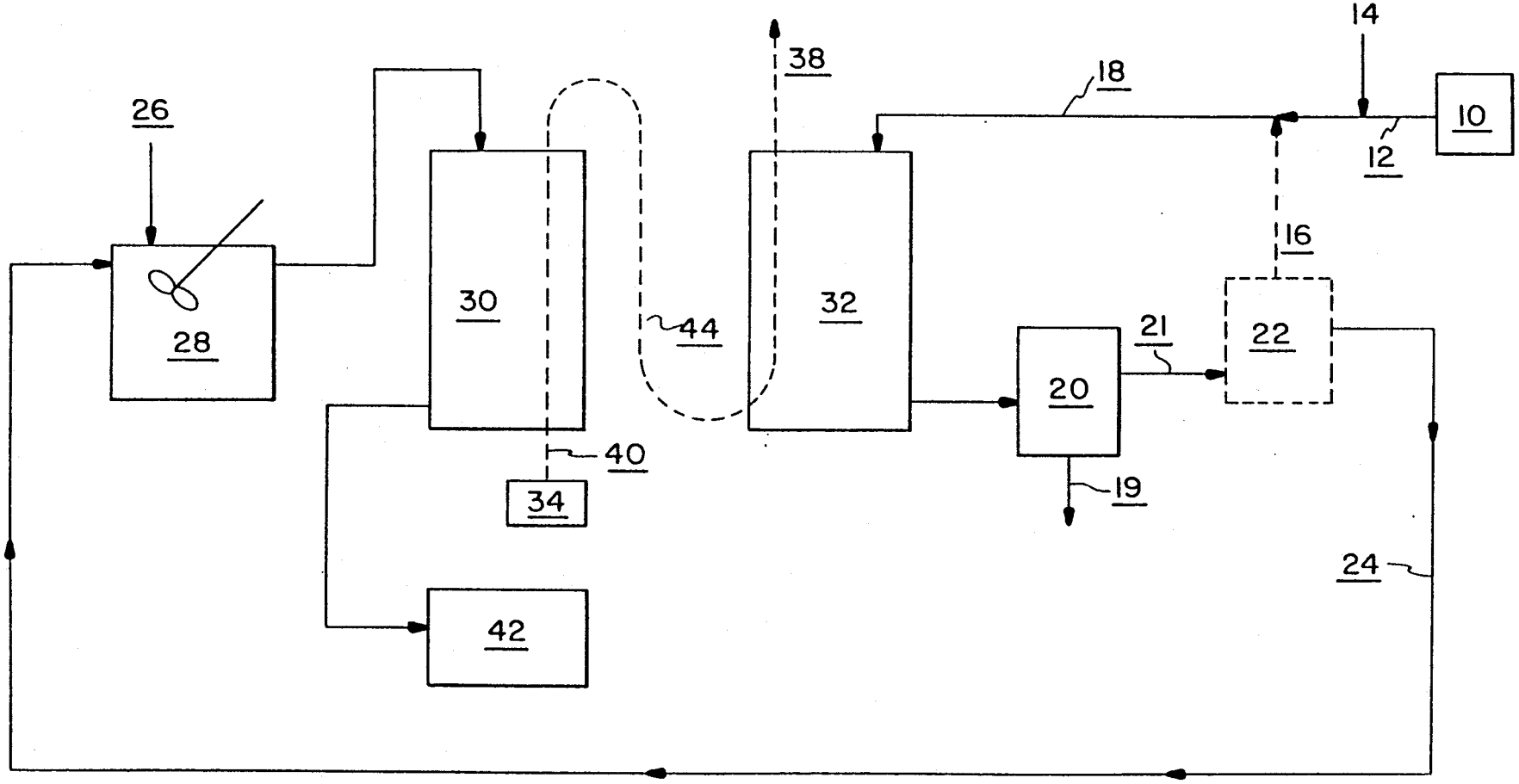
FIG. 1 is a block diagram of one embodiment of a process according to the present invention.

The present invention is directed to a process for recycling cyanide in the form of HCN from cyanide-containing waste streams. The process is preferably performed on tailings slurries resulting from mineral recovery processes, for example gold recovery processes employing cyanide leach solutions, such as vat leach, carbon-in-leach (CIL), and carbon-in-pulp (CIP) processes. Such tailings slurries typically have a pH of greater than about pH 10, contain from about 25 to about 40 weight percent solids and from about 10 ppm to about 1000 ppm cyanide, more typically from about 100 ppm to about 600 ppm cyanide.

The recovery of cyanide from slurries is advantageous for a number of reasons. Elimination of sedimentation or clarification steps reduces both capital and operating costs for the process. The recovery of cyanide can reduce operating costs and reduce the hazards associated with the manufacture, transport and storage of the reagent. Reduction of the total and weak acid dissociable (WAD) cyanide content entering the tailings impoundment minimizes the toxic effects of cyanide on wildlife and reduces the potential for the generation of leachate containing unacceptable levels of metals and cyanide. The requirement for installing a lining in the tailings impoundment can be eliminated for many applications. The reduction of total cyanide to acceptable levels in mine backfill ca eliminate the need for wash plants in some circumstances. The reduction of the total cyanide and metals concentration in the decant water and associated cyanide waste waters significantly decreases the costs while increasing the reliability and performance of downstream treatment processes. The generation of undesirable treatment byproducts such as ammonia and cyanate can be minimized thereby reducing significant capital outlays required for treatment of such materials. Additionally, the recovery and recycle of a substantial amount of cyanide from mineral recovery streams, particularly from vat leaching, CIL and CIP tailings, permits higher levels of cyanide to be economically used in the leach, resulting in higher and more rapid recovery of precious metal values.

The cyanide feed streams from mineral recovery processes are typically above pH 9 and normally above pH 10. A first step in one embodiment of the cyanide recovery process according to the present invention involves adjusting the pH of the stream of the cyanide-containing mixture being treated to a range from about pH 5 to about pH 8.5, preferably from about pH 5.5 to about pH 7.5, and more preferably from about pH 5.5 to about pH 6.5. However, the optimum pH can vary depending on the contents of the particular ore slurry.

In an alternative embodiment, the pH is adjusted to between about pH 6 and about pH 8.5, preferably from about pH 7 to about pH 8.5. In this embodiment, the amount of acidifying agent is preferably minimized.

The adjustment of the pH of the slurry can be accomplished through the use of an acidifying agent. It has been found that adjusting the pH to below about pH 4.5 results in the formation of metal cyanide complexes such as copper cyanide and iron cyanide, which precipitate as sludge. Using a near neutral or basic pH can advantageously reduce problems associated with an increase in sulfate and total dissolved solids concentrations which can result in precipitation of materials such as calcium sulfate. Proper adjustment of the pH results in the formation of HCN in solution.

The HCN is then volatilized, by contacting with a gas, preferably by contacting with air. According to a preferred embodiment of the present invention, the volatilized HCN gas can then be contacted with a precious metals-containing ore, for example in an ore slurry, to recover precious metals therefrom. Alternatively, the HCN can be contacted with decant or reclaim water from a tailings pond to recycle and conserve cyanide.

The tailings remaining after the HCN volatilization step can be further treated to remove remaining cyanide and/or metals and metal complexes. Such optional treatment can include metal coagulation, pH adjustment of the tailings in order to precipitate metal complexes, and/or further cyanide removal by known treatments such as oxidation (e.g. with $H_2O_2$ or $SO_2$) and/or biological treatments.

As a result of the process of the present invention, treated ore tailings have a greater long-term stability. Potentially toxic species, for example silver, will be less likely to be mobilized because of the lower cyanide concentration in the tailings pond. Discharge concentrations of cyanide can be lowered and management requirements after mine closure reduced.

Previous cyanide recovery processes have typically used a separate caustic solution, for example a sodium hydroxide solution, to recover cyanide from the volatilized HCN. However, this is to be contrasted with the present process which instead recycles the HCN back to an ore slurry or to the decant water to conveniently and efficiently conserve resources. The reduction of caustic consumption is critical to the ore refining industry. It is estimated that 30 to 40 percent of the cost of cyanide-based recovery processes is due to caustic consumption.

Referring to FIG. 1, precious metals-containing ore 12 is removed from a mine 10. The ore 12 is slurried, for example with decant water, to form a solids-containing slurry. A pH adjusting agent 14 such as calcium oxide (CaO) is added to adjust the pH to above about pH 10. Additionally, barren solution 16 from an optional filtration step 22 can be recycled back into the ore slurry 18.

The ore slurry 18 can then be contacted with HCN 44 in a cyanide recovery tower 32, as is discussed hereinbelow. Precious metals 19 are then recovered 20, as is known in the art, and the precious metals depleted slurry 21 can optionally be treated in a thickening, filtration or solid separation apparatus 22.

The cyanide-containing precious metals depleted waste stream 24 is then treated in a pH adjustment zone 28 in order to obtain a stream having a pH in the range from about pH 5 to about pH 8.5, preferably from about pH 5.5 to about pH 7.5 and more preferably from about pH 5.5 to about pH 6.5. Alternatively, the pH can be adjusted to from about pH 7 to about pH 8.5. Although FIG. 1 illustrates an essentially closed loop system with regard to the cyanide, a cyanide-containing slurry stream from any minerals recovery process can be used as a feed for the present cyanide recycle process.

In a preferred embodiment, the cyanide-containing waste stream 24 is a tailings slurry from a vat leach which can use a precipitation method, such as with zinc, to recover metal values, or a carbon-in-pulp or a carbon-in-leach metal recovery process in which tailings have a pH above about pH 10 and normally in the range from about pH 10.5 to about pH 11.5, a solids content from about 20 to about 50 weight percent, more typically from about 25 to about 40 weight percent, and from about 100 ppm to about 600 ppm cyanide. Based upon dissociation constants, more rapid recovery of free cyanide and weakly bound cyanide, e.g., NaCN and $Zn(CN)_2$, can be accomplished at a pH in the range of about pH 4.5 to about pH 8.5, whereas for a weak acid dissociable (WAD) cyanide, about pH 4.0 is optimal. It has been found that the instant process can provide a high recovery of the ionic cyanide and a substantial recovery of the WAD cyanide even at about pH 6 or above. Additionally, at below about pH 3 or pH 4, some metal complexes, e.g. $Cu(CN)_2$, will precipitate and subsequently resolubilize when the pH is increased. The dissolution of metals such as iron, copper, nickel, etc. can advantageously be minimized when a pH of at least about pH 6 is used.

The cyanide-containing stream 24 is acidified in zone 28 by adding an acidifying agent 26. The pH adjusting zone can be, for example, a sealed, agitated reactor vessel. Retention time is typically from about 5 to about 20 minutes.

The acidifying agent 26 is preferably $H_2SO_4$ added in the form of an aqueous solution containing about 10 weight percent acid. Other mineral acids can be used such as hydrochloric acid, nitric acid, phosphoric acid, $H_2SO_3$, mixtures of $H_2SO_3$ and $SO_2$, etc. or organic acids such as acetic acid, as well as mixtures of acids. The particular acidifying agent of choice depends on such factors as economics, particularly the availability of acidic streams from other processes, and the composition of the cyanide-containing stream being treated. For example, if the stream contains materials which are detrimentally affected by an oxidizing agent, nitric acid would probably not be useful. The function of the acidifying agent 26 is to reduce the pH in order to shift the equilibrium from cyanide/metal complexes to $CN^-$ and ultimately to HCN.

The pH adjusted stream is then transferred from zone 28 to a volatilization zone 30 as shown in FIG. 1. Preferably, at least one packed tower is used in which the slurry is passed in countercurrent flow to the volatilization gas.

In the volatilization zone 30, HCN is transferred from the liquid phase to the gas phase using a volatilization gas 40. Air is a preferred volatilization gas although other gases such as purified nitrogen or off-gases from other processes can be used. The gas can also provide the turbulence required. Air can be introduced into the pH adjusted mixture in the volatilization zone 30 by any appropriate method. For example, a diffuser basin or channel can be used without mechanical dispersion of the air. Alternatively, an air sparged vessel and impeller for dispersion can be employed. Baffles can be arranged in the vessel, e.g., radially, to assist in agitation of the slurry. In other alternative embodiments, a modified flotation device or a countercurrent flow tower with a grid, a plurality of grids, packing, a plurality of trays, etc., can be used.

Volatilization of HCN by gas stripping involves the passage of a large volume of low pressure compressed gas through the acidified mixture to release cyanide from solution in the form of HCN gas. Alternatively, the mixture can be contacted with the volatilization gas, e.g. in a countercurrent flow tower.

When a stripping reactor is used, the pH adjusted mixture is transferred from the initial pH adjustment zone 28 to the stripping reactor (volatilization zone) 30. Incoming volatilization gas 40 is distributed across the base of the stripping reactor 30 using gas sparger units designed to prevent solids from entering the gas pipework on cessation of gas flow. Preferably, coarse to medium sized bubbles are used to provide sufficient gas volume and to minimize clogging of gas ports with materials such as clay. The resulting stripping gas stream is continuously removed from the enclosed atmosphere above the slurry in association with removal of the extracted gas stream. When the volatilization gas is air, the preferred flow is from about 250 to about 1,000 cubic meters of air per cubic meter of pH adjusted mixture per hour, more preferably, from about 300 to 800 $m^3/m^3$, and most preferably from about 350 to about 700 $m^3/m^3$. This flow is maintained for a time sufficient to remove the desired level of HCN. The time required to accomplish this removal depends on the air flow rate, the waste stream feed rate, the waste stream depth in the stripping reactor, the pH and the temperature of the mixture. Normally, the stripping can be accomplished in a period of from about 2 to about 6 hours. Preferably, a flow rate of from about 300 to about 800 $m^3/m^3$ is used which corresponds to a flux of from 2.8 to 7.4 cubic meters air per square meter of pH adjusted mixture per minute, based on a period of 3 to 4 hours.

While the key function of air in the system is to provide an inert carrier gas and transport, the air also has secondary effects. The first is to provide energy to overcome barriers to HCN transfer to the gas phase. Although HCN is very volatile, having a boiling point of about 26° C., it is also infinitely soluble in water, and HCN solutions have a high degree of hydrogen bonding. Thus, there are significant resistances to the mass transfer of HCN that can be overcome by using the sparged air to provide the necessary energy in the form of turbulence. Furthermore, the dissociation equilibrium constants for most of the metal-cyanide complexes are low at the desired pH ranges; therefore, it is necessary for the $CN^-$ concentration to be close to zero in order to push the equilibrium far enough toward CN formation in order to substantially dissociate the complexes. This can be achieved by efficient formation of HCN from $CN^-$, which is pH dependent, and then by removal of HCN from the solution, which is energy dependent.

As indicated above, the preferred retention time in the volatilization zone 30 is from about 2 to about 6 hours with a stripping reactor. In a stripping reactor, the liquid height in the reactor is preferably less than about 3 meters. This preferred depth is due to the function of air in the system and the possibility of bubble coalescence if the depth is greater than about 3 meters. The necessary retention time can be achieved by using a single reactor or a plurality of reactors arranged in parallel, in series, or a combination, as is appropriate for the particular feed stream and throughput. For example, multiple trains of reactors can be arranged in parallel with a plurality of stripping reactors arranged in series in each train.

In a preferred embodiment of the present invention, at least one packed tower is used in the volatilization zone. A packed tower useful in the instant process normally has a means for distributing the slurry substantially uniformly across the top of the packing material. The distribution means is located near the top of the tower and above the packing medium. It is preferred that the distributing means minimize interference between the slurry and rising volatilization gas to minimize the flow disturbance and provide an effective distribution of the slurry over a substantial cross-sectional area of the packing material. For example, a multiple weir, V-notch assembly can be used. The distributing means can be made of any suitable material such as steel or ceramic. The tower can also be equipped with a demister. The demister functions to suppress or disperse aerosols and can be formed from a fine screen or grid, glass wall or other porous media.

The packing material useful in the tower can be any mass-transfer media which provides a high void ratio, i.e., a high surface area to volume ratio (e.g., square meter per cubic meter). Preferably, the void ratio is above about 50 percent, more preferably above about 80 percent and most preferably above about 85 percent. The openings in the packing material must be sufficiently large to allow free passage of the particles contained in the slurry. The height of the packing is typically from about 3 to about 10 meters, more preferably from about 4 to about 8 meters, most preferably about 6 to about 7 meters, depending on the desired pressure drop.

It has surprisingly been found that cyanide can be efficiently stripped from an ore slurry by utilizing a packed tower. The use of a packed tower enables efficient and cost effective cyanide removal.

To maximize efficiency of the process, it is important to control the viscosity of the slurry entering the packed tower. It has been found that increasing the viscosity of the slurry within an operative range improves the mass transfer and removal of hydrogen cyanide from the solution. However, if the viscosity is too high, flow of the slurry through the packing can be affected with subsequent operating problems and a decrease in removal of the hydrogen cyanide. The viscosity of the slurry is affected by the percent solids contained in the slurry, the type of ore being treated, and the temperature of the slurry. Normally, the weight percent solids in the slurry should not exceed about 60 weight percent. Preferably, no more than about 50 weight percent solids should be contained in the slurry. More preferably, the slurry should contain from about 25 to about 45 weight percent solids and most preferably from about 30 to about 40 weight percent solids.

As discussed hereinabove, the packing material should have a high void ratio. The packing can be any material that can withstand the abrasion and operating conditions in the packed tower. Preferred materials include stainless steel, ceramic materials and plastic materials, for example, polyethylene and polypropylene. Examples of effective packing materials include 50 millimeter and 75 millimeter Pall rings, Rashig rings, Tellerette rings, saddles and grid, although it is anticipated that other packing materials can be used. The tower can be constructed from any material capable of withstanding the reaction conditions and the chemicals which contact the internal surface of the tower. The preferred materials include fiberglass, steel (both mild and stainless) and concrete.

Air is introduced into the stripping tower in countercurrent flow to the slurry. The air can be introduced by blower 34 as illustrated, or air can be forced through by negative pressure induced by a fan. The tower is operated under a negative pressure with the air-HCN mixture being positively removed. When negative pressure is induced by a fan, the flow of air extracted by the fan preferably exceeds the flow of stripping gas so that all of the system above the packing in the zone 30 operates under negative pressure to minimize any leaking of HCN. Preferably, a pressure drop of from about 15 millimeters to about 30 millimeters water gauge per meter of packing height is maintained. Pressure drop is the difference in pressure between the top and bottom of the tower and the pressure drop is a function of the air flow or air flux, and the cross-sectional area of the tower.

The slurry is fed to the packed tower at a rate which maintains a desired pressure drop over the length of the tower. Normally, the tower is operated in the range of about 10 percent to about 70 percent of the flooding volume and preferably, in a range of about 20 percent to about 50 percent of the flooding volume. The degree of flooding is based upon filling all of the void space in the tower being considered 100 percent flooding.

The treated tailings which remain in reactor 30 after the HCN volatilization step can be removed and disposed 42. Optionally, complexed metals can be coagulated by methods known in the art, for example using $FeCl_3$ or TMT, an organic sulfide available from the DeGussa Corporation. Additional cyanide can also be removed from the pH adjusted tailings, for example by known oxidation techniques, e.g. using $H_2O_2$ or $SO_2$, or by known biological processes.

In other systems, the stream of volatilized HCN and volatilization gas would be removed from zone 30 and transferred into a cyanide recovery zone where a basic material, such as a caustic solution, would be used to absorb HCN gas. According to the present invention, the volatilized HCN gas 44 is recycled to cyanide recovery zone 32 where it is contacted with a precious metals-containing ore, preferably in the form of a slurry, to recover precious metals therefrom. Thus, HCN is recycled to an ore slurry where the cyanide is advantageously utilized to recover the precious metals. In addition to the recycled HCN, it may be advantageous to add additional cyanide-containing compounds to the ore slurry to effectively solubilize precious metals. For example, any soluble cyanide salt such as KCN, NaCN or CaCN can be utilized for this purpose.

The cyanide recovery zone 32 preferably includes packed towers to enhance the efficiency of the precious metals recovery process. The packed towers useful in the cyanide recovery have essentially the same characteristics as the packed towers described hereinabove for the cyanide stripping zone. However, it is preferable that the packed towers utilized to contact the slurry with the hydrogen-cyanide gas be slightly larger than those utilized in the absorption process. This is because of viscosity differences and differences in the transfer mechanism.

Figure 2:
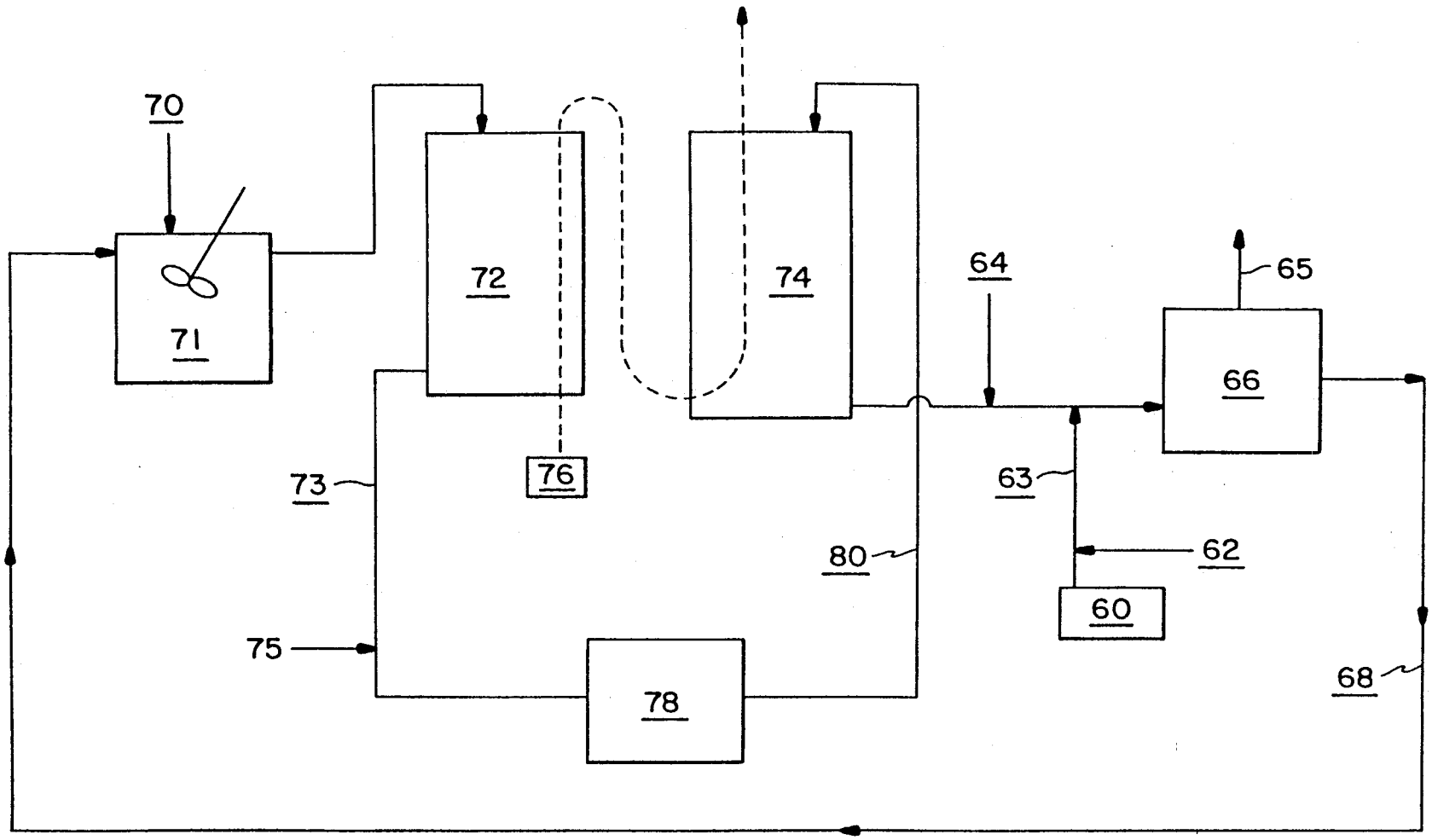
FIG. 2 is a block diagram of another embodiment of a process according to the present invention.

In an alternative embodiment depicted in FIG. 2, the volatilized HCN is contacted with recycled decant water or reclaim water 80 from, for example, a tailings pond, tank or holding basin. In this process, ore 63 is recovered from a mine 60 and the pH of the ore slurry is raised by adding a pH adjusting agent 62, such as CaO. Precious metals 65 such as gold or silver are recovered in recovery zone 66. The precious metals depleted tailing slurry 68 is then acidified in the acidification zone 71 by adding an acidifying agent 70 such as $H_2SO_4$.

After acidification, HCN is removed from the waste stream in the cyanide removal zone 72 by contacting with a gas, such as air, as described with reference to FIG. 1.

After cyanide removal, the waste stream 73 is renuetralized by the addition of a base 75 and is moved to tailings disposal 78. Thereafter the reclaim, or decant, water 80 from the tailings disposal 78 is introduced into a cyanide recovery zone 74 where it is contacted with the HCN gas. Thereafter, the reclaimed or decant water can be pH adjusted by adding, for example, CaO 64, and reintroduced back to a precious metals-containing ore slurry.

While various embodiments of the present invention have been described in detail, it is apparent that modifications and adaptations of those embodiments will occur to those skilled in the art. However, it is to be expressly understood that such modifications and adaptations are within the spirit and scope of the present invention.

What is claimed is:

1. A process for recycling cyanide in a precious metals recovery circuit, comprising the steps of:

(a) recovering precious metals from a precious metals containing slurry to form a cyanide-containing waste stream;

(b) adjusting the pH of the cyanide-containing waste stream;

(c) volatilizing HCN in said waste stream; and (d) contacting the volatilized HCN with a precious metals-containing slurry.

2. A process as recited in claim 1, wherein the adjustment of the pH of the cyanide-containing waste stream is accomplished using an acid.

3. A process as recited in claim 2, wherein said acid is $H_2SO_4$.

4. A process as recited in claim 1, wherein said cyanide-containing waste stream is a tailings slurry.

5. A process as recited in claim 4, wherein said tailings slurry results from a carbon-in-leach recovery process.

6. A process as recited in claim 4, wherein said tailings slurry results from a carbon-in-pulp recovery process.

7. A process as recited in claim 1, wherein the pH of said waste stream is adjusted to between about pH 5 and about pH 8.5.

8. A process as recited in claim 1, wherein the pH of said waste stream is adjusted to between about pH 5.5 and about pH 8.5.

9. A process as recited in claim 1, wherein the pH of said waste stream is adjusted to from about pH 6 to about pH 8.5.

10. A process as recited in claim 1, wherein said volatilization step is accomplished by introducing air into said pH adjusted stream or by introducing said pH adjusted stream into air.

11. A process as recited in claim 1, wherein said ore comprises precious metals selected from the group consisting of silver and gold.

12. A process as recited in claim 1, wherein said volatilization step occurs in at least one packed tower.

13. A process as recited in claim 1, wherein said contacting step occurs in at least one packed tower.

14. A process for recycling cyanide in a precious metals recovery circuit, comprising the steps of:

(a) forming a slurry comprising cyanide and precious metals-containing ore;

(b) recovering precious metals from said precious metals containing slurry to form a cyanide-containing waste stream;

(c) adjusting the pH of the cyanide-containing waste stream;

(d) volatilizing HCN in said waste stream;

(e) contacting the volatilized HCN with decant water to recover cyanide from said waste stream; and (f) recycling said decant water to said slurry.

15. A process as recited in claim 14, wherein the adjustment of the pH of the cyanide-containing waste stream is accomplished using an acid.

16. A process as recited in claim 15, wherein said acid is $H_2SO_4$.

17. A process as recited in claim 14, wherein said cyanide-containing waste stream is a substantially barren solution.

18. A process as recited in claim 14, wherein said cyanide-containing waste stream is a tailings slurry.

19. A process as recited in claim 18, wherein said tailings slurry results from a carbon-in-leach recovery process.

20. A process as recited in claim 18, wherein said tailings slurry results from a carbon-in-pulp recovery process.

21. A process as recited in claim 14, wherein the pH of said waste stream is adjusted to between about pH 5 and about pH 8.5.

22. A process as recited in claim 14, wherein the pH of said waste stream is adjusted to between about pH 5.5 and about pH 7.5.

23. A process as recited in claim 14, wherein the pH of said waste stream is adjusted to from about pH 6 to about pH 8.5.

24. A process as recited in claim 14, wherein said volatilization step is accomplished by introducing air into said pH adjusted stream or by introducing said pH adjusted stream into air.

25. A process as recited in claim 14, wherein said ore comprises precious metals selected from the group consisting of silver and gold.

26. A process as recited in claim 14, wherein said volatilization step occurs in at least one packed tower.

27. A process as recited in claim 14, wherein said contacting step occurs in at least one packed tower.

28. A process for recovering precious metals from a precious metals containing ore, comprising the steps of:

(a) contacting said ore with a cyanide-containing stream to form an ore slurry;

(b) recovering said precious metals from said slurry to form a precious metals-depleted tailings slurry;

(c) adjusting the pH of said tailings slurry to between about pH 5.5 and about pH 8.5;

(d) volatilizing HCN from said pH adjusted slurry in a packed tower; and (e) contacting at least a portion of said volatilized HCN with an ore slurry.

* * * * *

UNITED STATES PATENT AND TRADEMARK OFFICE

CERTIFICATE OF CORRECTION

PATENT NO. : 5,254,153

DATED : October 19, 1993

INVENTOR(S) : Mudder et al.

It is certified that error appears in the above-indentified patent and that said Letters Patent is hereby corrected as shown below:

On the title page, Item [19], line 2, "Mudder" should read — Mudder et al. —

In the left column, item [75] Inventor: Terry I. Mudder, Duvall, Wash. should also include — Adrian J. Goldstone, Waihi Beach, New Zealand —

Column 4, line 56 "ca" should read — can —

Signed and Sealed this

Twenty-seventh Day of September, 1994

*Attest:*

Bruce Lehman

BRUCE LEHMAN

*Attesting Officer*

*Commissioner of Patents and Trademarks*